US008186531B2

(12) United States Patent
Parikh et al.

(10) Patent No.: US 8,186,531 B2
(45) Date of Patent: May 29, 2012

(54) TAMPER-EVIDENT CONTAINER

(75) Inventors: Samir R. Parikh, Brampton (CA); Sajith Chenat, Brampton (CA)

(73) Assignee: Par-Pak Ltd., Brampton (CA)

( * ) Notice: Subject to any disclaimer, the term of this patent is extended or adjusted under 35 U.S.C. 154(b) by 422 days.

(21) Appl. No.: 12/548,090

(22) Filed: Aug. 26, 2009

(65) Prior Publication Data

US 2010/0051620 A1 Mar. 4, 2010

Related U.S. Application Data

(60) Provisional application No. 61/092,988, filed on Aug. 29, 2008.

(51) Int. Cl.
*B65D 41/32* (2006.01)

(52) U.S. Cl. ..... 220/266; 220/835; 220/836; 220/265; 206/1.5

(58) Field of Classification Search ..... 220/270, 220/260, 265, 266, 267, 835, 810, 836; 215/901; 206/1.5

See application file for complete search history.

(56) References Cited

U.S. PATENT DOCUMENTS

| | | | | |
|---|---|---|---|---|
| 2,915,214 | A | 12/1959 | Morris | |
| 4,602,718 | A | 7/1986 | Dutt | |
| 4,966,294 | A * | 10/1990 | Mack et al. | 220/266 |
| 5,219,087 | A | 6/1993 | Christensson | |
| 5,249,694 | A | 10/1993 | Nelson | |
| 5,398,836 | A | 3/1995 | Luch et al. | |
| 5,490,827 | A * | 2/1996 | Van de Geijn et al. | 493/109 |
| 5,507,406 | A | 4/1996 | Urciuoli et al. | |
| 5,573,134 | A | 11/1996 | Chenault et al. | |
| 5,788,105 | A | 8/1998 | Foos | |
| 5,897,011 | A | 4/1999 | Brilliant | |
| 5,931,332 | A | 8/1999 | Mygatt et al. | |
| 6,257,435 | B1 | 7/2001 | Chedister et al. | |
| 7,073,680 | B2 | 7/2006 | Boback et al. | |
| 7,118,003 | B2 | 10/2006 | Sellari et al. | |
| 8,028,851 | B2 * | 10/2011 | Vovan et al. | 220/266 |
| 2003/0034323 | A1 | 2/2003 | Smith et al. | |
| 2004/0118848 | A1 | 6/2004 | Marshall | |
| 2005/0161455 | A1 | 7/2005 | Studee | |
| 2007/0045317 | A1 | 3/2007 | Rosender et al. | |
| 2007/0138046 | A1 | 6/2007 | Vovan | |
| 2007/0138180 | A1 | 6/2007 | Vovan | |
| 2008/0087669 | A2 | 4/2008 | Boback et al. | |

FOREIGN PATENT DOCUMENTS

| | | |
|---|---|---|
| EP | 0752374 | 8/1997 |
| FR | 2811638 | 1/2002 |
| GB | 2346868 | 8/2000 |
| GB | 2412651 | 10/2005 |
| WO | 2005/082733 | 9/2005 |

* cited by examiner

*Primary Examiner* — Mickey Yu
*Assistant Examiner* — Kareen Rush
(74) *Attorney, Agent, or Firm* — Bereskin & Parr LLP/S.E.N.C.R.L.,s.r.l.

(57) ABSTRACT

A container includes a receptacle having a bottom panel, at least one wall extending upwardly from the bottom panel, and a lid coupling region extending from an upper portion of the at least one wall. The lid coupling region includes an upstanding barrier wall, and a locking member movable from a blocking position to a non-blocking position. The container further comprises a lid having a receptacle coupling region extending about the periphery thereof. The receptacle coupling region includes an outer edge that seats behind the barrier wall. A portion of the outer edge can be exposed for gripping access to remove the lid when the locking member is moved to the non-blocking position.

19 Claims, 7 Drawing Sheets

TAMPER-EVIDENT CONTAINER

This application claims the benefit of Provisional Application No. 61/092,988, filed Aug. 29, 2008, which is hereby incorporated herein by reference.

FIELD

The teaching disclosed herein relates to containers having a receptacle and a lid, and features providing visual indication that the lid may have been removed and replaced.

BACKGROUND

Containers are used to store many types of items, such as foodstuffs, medicine, or numerous other types of materials.

U.S. Pat. No. 5,507,406 (Urciuoli) discloses a container comprising a receptacle and a lid combination which are formed of thermoformed plastic such as pPVC (polyvinyl chloride), PS (polystyrene), or PET (polyethylene). The receptacle and the lid have sections thereof which nest intimately together to form a seal. The receptacle includes a frangible portion which breaks when the lid is removed.

U.S. Pat. No. 7,073,680 (Boback et al.) discloses a tamper-resistant container with tamper-evident features which includes a cover portion defining a outwardly extending peripheral flange, a base portion defining an upper peripheral edge, a hinge joining the outwardly extending peripheral flange with the base portion and an engagement mechanism for maintaining the peripheral flange adjacent to the upper peripheral edge when the container is closed. The upper peripheral edge includes an upwardly projecting bead extending substantially about the perimeter of the base portion that is configured to render the outwardly extending flange of the cover portion relatively inaccessible when the container is closed. The hinge includes a frangible section, which upon severing, provides a projection that extends out beyond the upwardly projecting bead of the upper peripheral edge of the base portion, for facilitating the disengagement of the engagement mechanism and removal of the cover portion from the base portion to open the container.

United States Published Application No. 2007/0138180 (Vovan) discloses a container which includes a base that can hold food and a lid that closes on the base, which clearly indicates if the lid has been opened after a clerk loaded food into the base and closed the lid. The base and lid each have trapping portions and pull-open portions with a tear-tab, or tear-open barrier. To close the lid, a clerk projects a tab on the pull-open portion of the lid through a slot in the pull-open portion of the base, and then presses down the entire trapping portion of the lid into the trapping portion of the base. The lid cannot be lifted up because the tear-open barrier forming the top wall of the slot lies over the tab. To open the container, a person must tear the barrier so he/she can pull up the tab and open the lid. The fact that the barrier has been torn is designed to be obvious.

SUMMARY

The following summary is provided to introduce the reader to the more detailed discussion to follow. The summary is not intended to limit or define the claims.

According to one example of the Applicant's teaching, a container comprises a receptacle having a bottom panel, at least one wall extending upwardly from the bottom panel, and a lid coupling region extending from an upper portion of the at least one wall. The lid coupling region comprises at least one surface extending from the upper portion of the at least one wall to define an inwardly open recess. A seating surface is positioned above the recess. A barrier wall extends upwardly from an outer portion of the seating surface and extends about a portion of the periphery of the receptacle from a first position to a second position spaced perimetrically apart from the first position to define a gap region therebetween. A locking member positioned at the gap region and comprises a member wall extending upwardly from the outer portion of the seating surface. The locking member is movable from a blocking position to a non-blocking position. The container further comprises a lid having a receptacle coupling region extending about the periphery thereof. The receptacle coupling region comprises a projection receivable in the recess. A flange is positioned above and outwardly of the projection and has an outer edge. The flange is seatable on the seating surface when the projection is received in the recess. The outer edge has a concealed portion in perimetrical registration with the barrier wall, and a grasping portion in perimetrical registration with the member wall when the flange is seated on the seating surface. The grasping portion is generally inaccessible to a user when the locking member is the blocking position, and generally accessible to a user when the locking member is in the non-blocking position.

Containers having this configuration may be advantageous because the lid may be easily removed and replaced on the receptacle, and the locking member may be easily moved from the blocking position to the non-blocking position to provide access to the grasping region. Furthermore, the container may be tamper-proof, tamper-resistant, child-proof, and/or child-resistant.

In some examples, the seating surface comprises a first severable portion defined adjacent a first side of the locking member, and a second severable portion defined adjacent a second side of the locking member, and the locking member is user activated such that when the severable portions are severed by a user, the locking member is movable from the blocking position to the non-blocking position.

Such examples may be advantageous because the severing of the severable portions may provide visual evidence that the locking member has been activated, thereby indicating to a user that the container has been previously unlocked.

Furthermore, such examples may be advantageous because when the locking member is activated and moved to the non-blocking position to provide access to the grasping portion, a waste product is not generated. That is, the container may be unlocked without completely severing any portions from the container which need to be discarded.

In some examples, the severable portions are unbroken and continuous (relative to material of the container adjacent the severable portion), and are configured to be severed using a cutting tool. In other words, the gap region can be free of creases, perforations or similar lines of weakness. Such examples may be advantageous because accidental activation of the locking member may be prevented. For example, the locking member may be prevented from being activated by movement and contact that may occur during shipping.

In some examples, the seating surface may comprise a tab portion extending outwardly of the member wall, the tab portion is continuous with the barrier wall, and the severable portions defined in the tab portion. The tab portion may comprise visual indicators identifying the severable portions.

In some examples, a first slot is defined between the locking member and the first position, and a second slot is defined between the locking member and the second position. The first and second slots may be aligned with the first and second severable portions, respectively, and may be sized to receive a cutting tool and to prevent manual access to the outer edge when the locking member is in the blocking position. For example the first and second slots may be between 5 mm and 10 mm in width. Accordingly, the severable portions may be severed by inserting a cutting tool into each slot and using the cutting tool to sever the severable portions.

In some examples, the member wall can be perimetrically aligned with the barrier wall. In other examples, the member wall can be positioned outwardly of the barrier wall.

In some examples, the locking member can be pivotable about a hinge line defined in the seating surface. The hinge line may comprise a crease in the seating surface.

In some examples, the locking member can be positioned outwardly of the barrier wall, and the hinge line is positioned in the gap region between the locking member and the barrier wall.

In some examples, the barrier wall and the outer portion can meet at an angle of 90 degrees or greater. The lid can comprise a rib positioned inwardly of the projection and extending upwardly from the projection. The rib can have an upper end that is positioned above the flange and at or below an upper end of the barrier wall when the lid is secured to the receptacle.

In some examples, the locking member can comprise a projection extending upwardly from the seating surface. The projection can have a perimetrical wall and a top wall, and the member wall can be defined in the perimetrical wall. The top wall may comprise visual indicators instructing a user to move the locking member.

In some examples, the barrier wall can comprise an inner wall portion, an outer wall portion, and a top wall portion extending therebetween.

According to one or more examples of the Applicant's teaching, a method is provided for using the container, comprising activating the locking member, moving the locking member from the blocking position to the non-blocking position; and grasping the grasping portion and lifting the lid off of the receptacle.

In some examples, the locking member may be activated by positioning a cutting at a first severable portion of the seating surface and severing the first severable portion; and positioning a cutting at a second severable portion of the seating surface and severing the second severable portion.

According to one or more examples, a container comprises a receptacle having a bottom panel, at least one wall extending upwardly from the bottom panel, and a lid coupling region extending from an upper portion of the at least one wall. The lid coupling region comprises a first mating member extending from the upper portion of the at least one wall. A seating surface is positioned above the first mating member. A barrier wall extends upwardly from an outer portion of the seating surface and extends about a portion of the periphery of the receptacle from a first position to a second position spaced perimetrically apart from the first position to define a gap region therebetween. A locking member is positioned at the gap region and comprises a member wall extending upwardly from the outer portion of the seating surface. The locking member is movable from a blocking position to a non-blocking position. The container further comprises a lid having a receptacle coupling region extending about the periphery thereof. The receptacle coupling region comprises a second mating member mateable with the first mating member to secure the lid to the receptacle. A flange is seatable on the seating surface when the second mating member is mated to the first mating member. The flange has an outer edge, which has a concealed portion in perimetrical registration with the barrier wall, and a grasping portion in perimetrical registration with the member wall. The grasping portion is generally inaccessible to a user when the locking member is the blocking position, and generally accessible to a user when the locking member is in the non-blocking position.

DETAILED DESCRIPTION

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Figure 1:
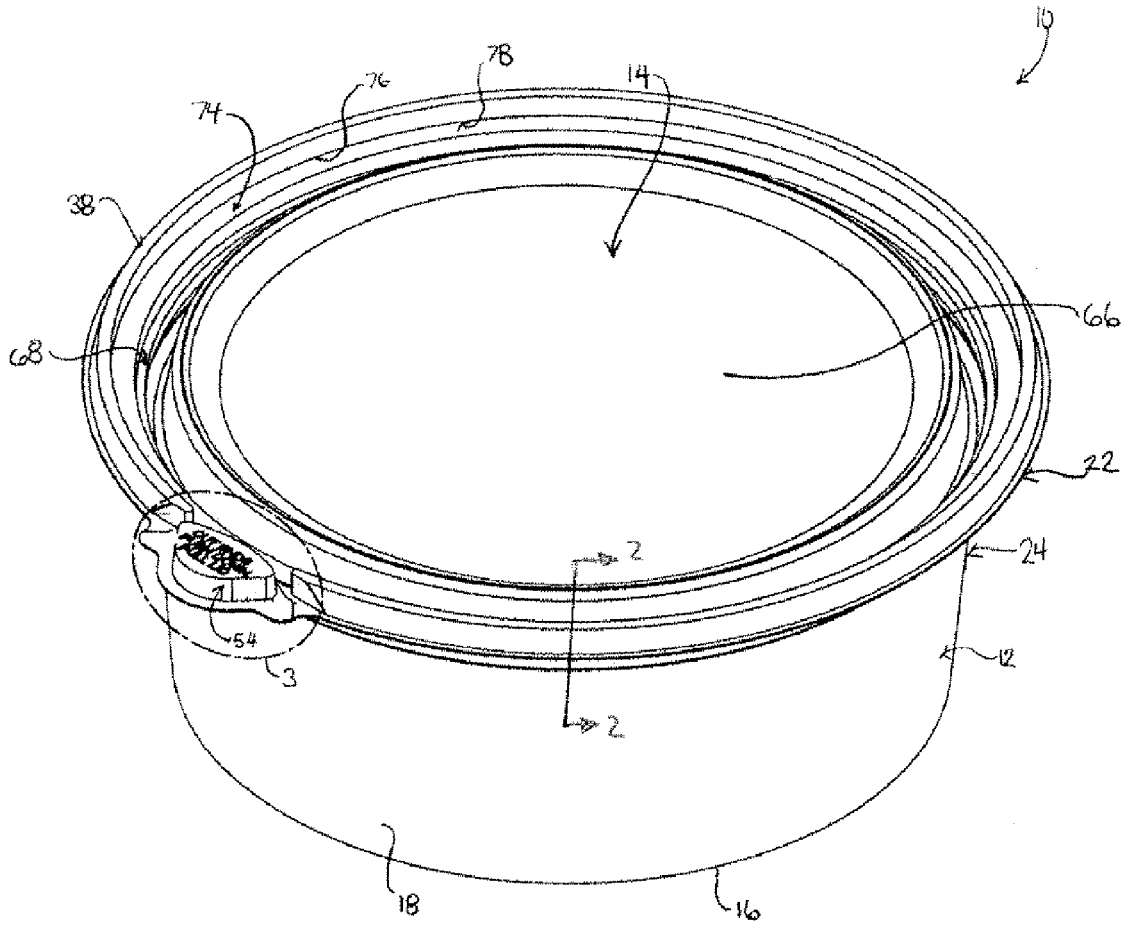
FIG. 1 is a perspective illustration of an example of a container in accordance with one or more aspects of the Applicant's teaching.

Referring to FIG. 1, an example of a container 10 in accordance with the applicant's teaching is shown. The container 10 comprises a receptacle 12, and a lid 14.

Receptacle 12 comprises a bottom panel 16, and at least one wall 18 extending upwardly from the bottom panel. In the example shown, bottom panel 16 is generally planar and circular, and the at least one wall 18 comprises a single generally cylindrical wall extending upright from the bottom panel 16. In alternate examples, the bottom panel 16 and the at least one wall 18 may be otherwise configured. For example, the receptacle 12 may be generally cubic, and may comprise a generally square bottom panel, and four walls extending upwardly from the bottom panel. The at least one wall may extend at an acute or obtuse angle from the bottom panel. Furthermore, the bottom panel may not be planar, and may be, for example, rounded.

In some examples (not shown), bottom panel 16 may comprise an annular indent extending adjacent the periphery of the panel 16. The annular indent may be configured to mate with a rib provided on a lid of another container, as will be described hereinbelow, such that the containers may be securely stacked. In alternate examples, the annular indent may not be provided, or may be otherwise configured.

Receptacle 12 further comprises a lid coupling region 22 extending from an upper portion 24 of the at least one wall 18. Lid coupling region 22 is configured to engage or mate with a portion of lid 14, such that the lid 14 may be easily removed and replaced on the receptacle 14.

Figure 2:
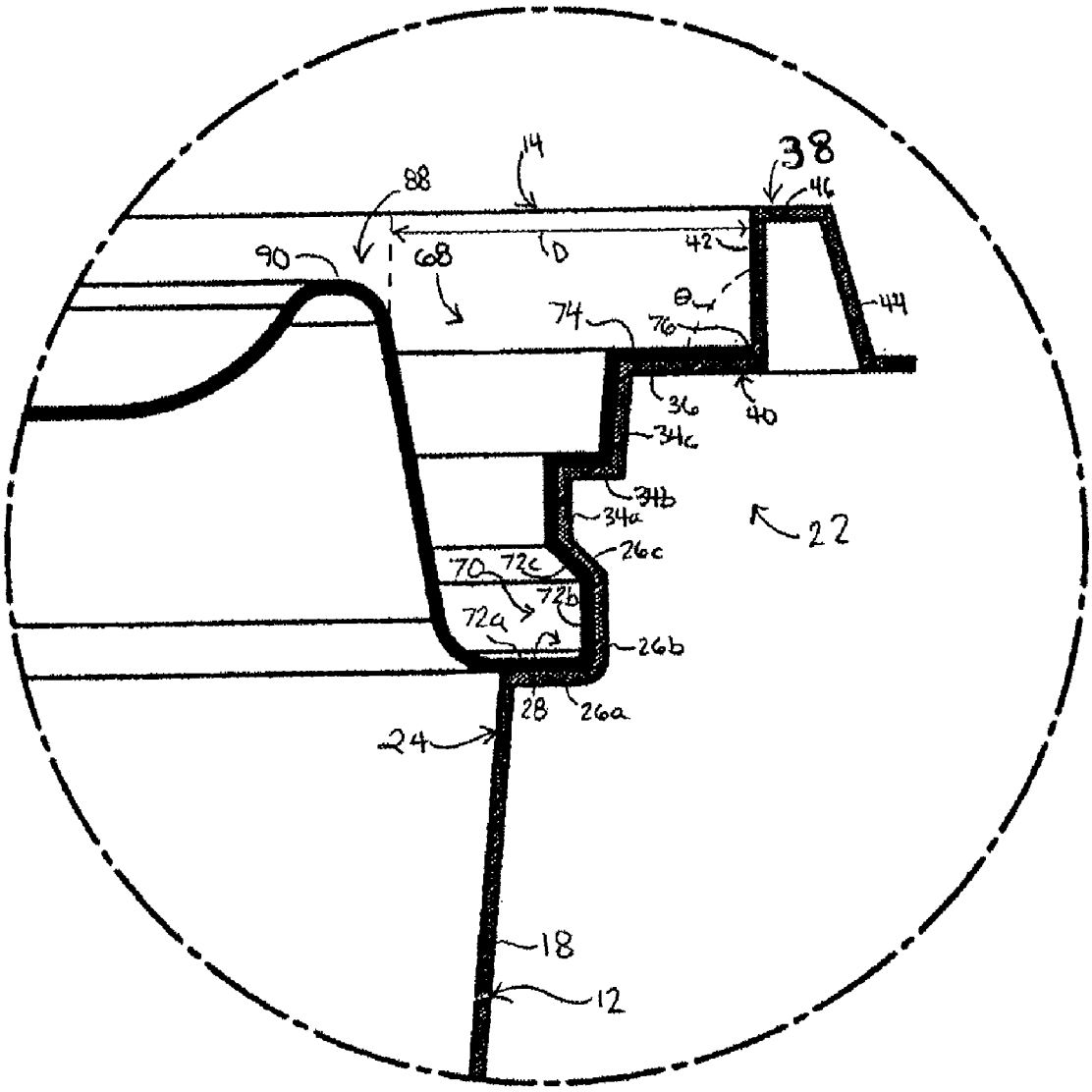
FIG. 2 is a cross-section taken along line 2-2 in FIG. 1.

Referring to FIG. 2, the lid coupling region 22 comprises at least one surface 26 extending from the upper portion 24 of the at least one wall 18 to define an inwardly open recess 28. The at least one surface can include a first surface 26*a* extending laterally outwardly from the upper portion 24 of the wall 18, a second surface 26*b* extending upwardly from the first surface 26*a*, and a third surface 26*c* extending laterally inwardly and upwardly from the second surface 26*b*. In such a configuration, the recess 28 is inwardly and upwardly open.

In some examples, the at least one surface 26 may be otherwise configured. For example, the at least one surface may comprise a single rounded surface extending sequentially outwardly, upwardly, and inwardly from the upper portion 24 of the at least one wall 18. Furthermore, the recess may be only inwardly open.

In the example shown, recess 28 extends around the entire periphery of the receptacle. However, in alternate examples, recess 28 may extend around only a portion of the periphery of the receptacle. Furthermore, a plurality of recess portions may be provided, which may be located at various positions around the periphery of the receptacle.

A seating surface 36 is positioned above the recess 28. The seating surface 36 can be positioned indirectly above the recess 28. In the example shown, a plurality of intermediate surfaces, 34*a*, 34*b*, and 34*c* are positioned between recess 28 and seating surface 36. In some examples, seating surface 36 may be positioned directly above recess 28 and extend directly from surface 26.

In the example shown, seating surface 36 is positioned outwardly of recess 28. However, in some examples, seating surface 36 and recess 28 may at least partially overlap.

Seating surface 36 may be of a variety of configurations. In the example shown, seating surface 36 comprises a generally planar surface defining a flange extending about the periphery of the receptacle. In other examples, seating surface 36 may extend around only a portion of the receptacle or a plurality of seating surface portions may be provided, which may extend from various positions around the periphery of the receptacle.

A barrier wall 38 extends upwardly from an outer portion 40 of the seating surface 36. The barrier wall may extend from the outer portion of the seating surface at an angle θ of 90° or greater. In the example illustrated, the barrier wall 38 extends generally perpendicularly from the outer portion 40 of the seating surface. Accordingly, when the receptacle is viewed from above, along an axis extending perpendicularly to the seating surface, the outer portion of the seating surface is visible. In other examples, the barrier wall may be at an angle θ of less than 90° with respect to the outer portion 40 of the seating surface 36.

In the example shown, the barrier wall 38 is three-dimensional, having a generally vertical inner wall portion 42, a generally vertical outer wall portion 44, and a generally horizontal top wall portion 46 extending therebetween. In some examples, the barrier wall may comprise, for example, only inner wall portion 42.

Figure 3:
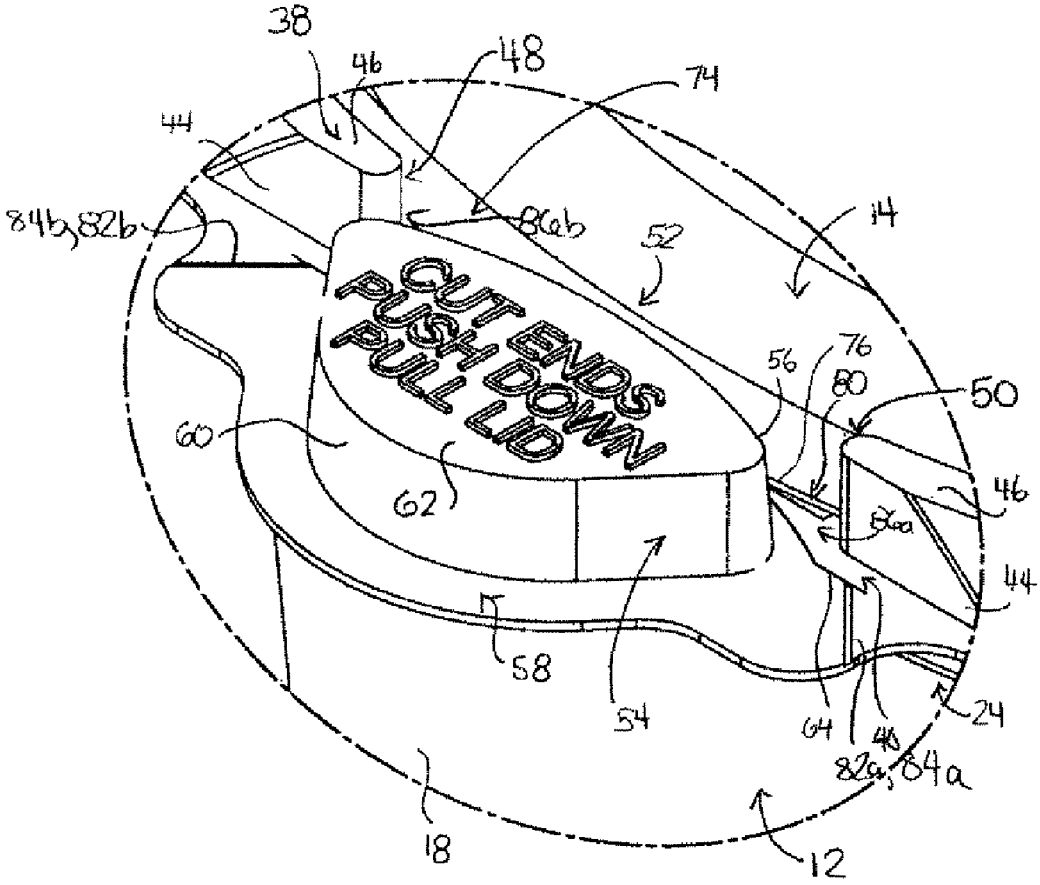
FIG. 3 is an enlarged view of the region shown in circle 3 in FIG. 1.

Referring to FIG. 3, the barrier wall 38 extends about a portion of the periphery of the receptacle, from a first position 48 to a second position 50. The first position 48 and the second position 50 are spaced perimetrically apart, such that a gap region 52 is positioned therebetween. In other words, the first position 48 and the second position 50 are spaced apart along the perimeter of the receptacle. The gap region 52 is generally opposite the barrier wall 38, and is absent the barrier wall 38. The barrier wall may, for example, extend around 95% of the periphery of the receptacle, and gap region may comprise, for example, about 5% of the periphery of the receptacle.

A locking member 54 is positioned at the gap region 52. The locking member 54 generally comprises a member wall 56 extending upwardly from the outer portion 40 of the seating surface 36. In the example shown, the locking member 54 is positioned adjacent the gap region 52 and the member wall 56 is positioned slightly outwardly of the barrier wall. Alternatively, the locking member 54 may be positioned within the gap region 52, and the member wall 56 may be perimetrically aligned with the barrier wall 38.

In the example shown, the seating surface comprises a tab portion 58 extending outwardly of the barrier wall, and the locking member 54 comprises a three-dimensional projection or button extending upwardly from the tab portion 58 of seating surface 36. The projection comprises a perimetrical wall 60 and a top wall 62, and the member wall 56 is defined by a portion of the perimetrical wall 60.

In the example shown, the receptacle further comprises a first slot 86*a* defined between the locking member 54 and the first position 48, and a second slot 86*b* defined between the locking member 54 and the second position 50. However, in other examples, slots 86*a*, 86*b* may not be provided. In such examples, the locking member 54 may abut the barrier wall 38, or may partially overlap the barrier wall 38.

Figure 4:
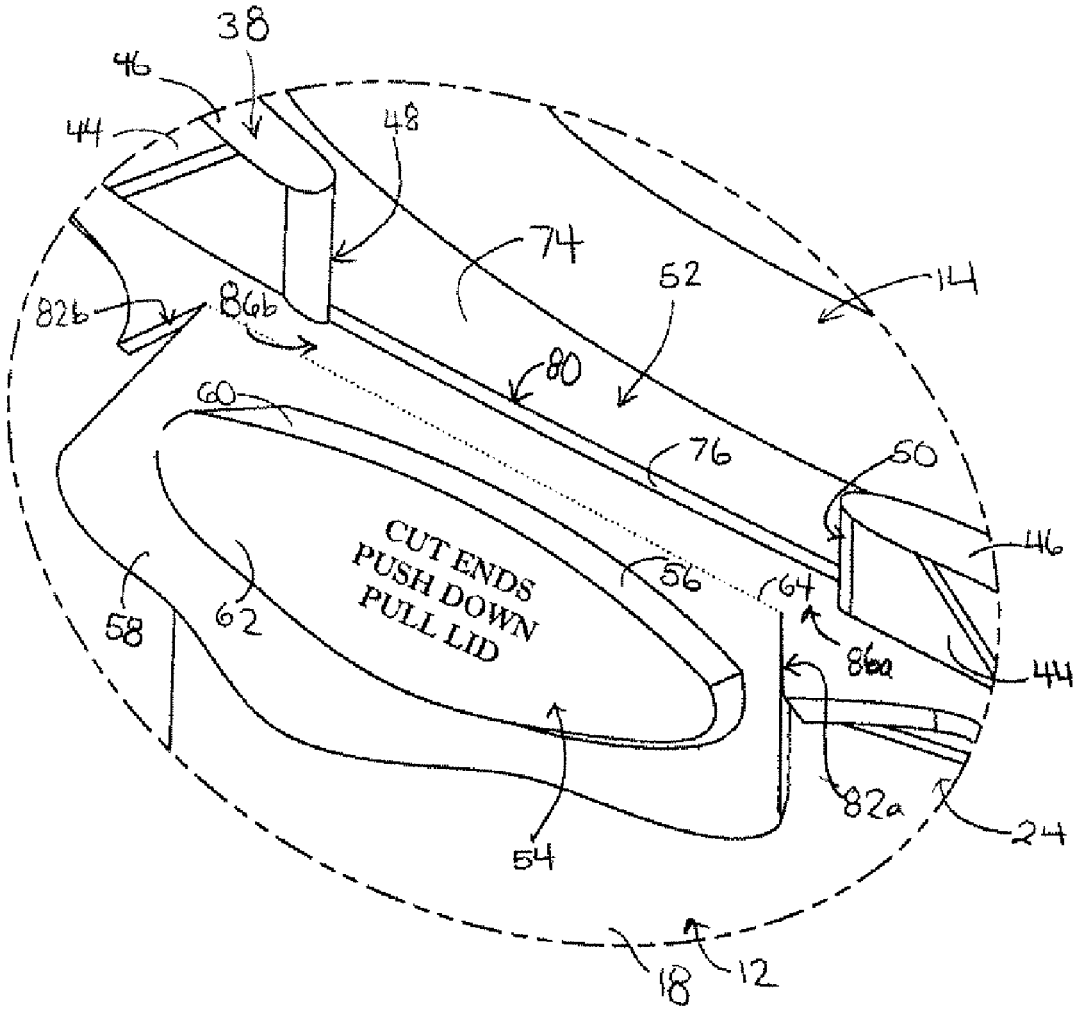
FIG. 4 is an enlarged view of the region shown in circle 3 in FIG. 1, showing the locking member in the non-blocking position.

The locking member 54 is movable from a blocking position, shown in FIG. 3, to a non-blocking position, shown in FIG. 4. In the embodiment shown, the blocking position is a generally upward position, and the non-blocking position is a generally downward position. That is, in the blocking position, the member wall 56 is generally upright. For example, the member wall 56 may be parallel to the barrier wall 38. In the non-blocking position, the member wall may be at an angle with respect to its positioning in the blocking position. For example, the member wall may be perpendicular to the barrier wall 38. Alternatively, the member wall 56 may be at an obtuse angle with respect to the barrier wall 38.

In some examples, in order to aid the user in moving the locking member from the blocking position to the non-blocking position, the locking member may be pivotable about a hinge line 64 defined in the seating surface. The hinge line 64 may comprise, for example, a weakened region and/or a creased region of the seating surface.

In alternate examples, a hinge line may not be provided. For example a user may be required to bend the seating surface adjacent the locking member in order to move the locking member to the non-blocking position.

Various mechanisms of action of the locking member will be described further hereinbelow.

Referring to again FIG. 1, lid 14 is configured to be removed from and replaced on receptacle 12. Lid 14 comprises a central portion 66 for covering receptacle 12, and a receptacle coupling region 68 extending about the periphery of the lid 14 for mating with the lid coupling region of receptacle 12.

Referring to FIG. 2, in the example shown, receptacle coupling region 68 comprises a projection 70. The projection 70 is receivable in recess 28, such that the lid 14 may be securely mounted to the receptacle 12. For example, if container 10 is inverted, projection 70 and recess 28 may prevent lid 14 from falling off of receptacle 12. In the example shown, the projection 70 is defined by a first outwardly extending surface 72*a*, a second upwardly extending surface 72*b*, and a third inwardly and upwardly extending surface 72*c*. In some examples, projection 70 may be otherwise shaped, in order to mate with recess 28. For example, if recess 28 is rounded, projection 70 may also be rounded. Furthermore, if recess 28 extends around only a portion of the periphery of the receptacle, projection 70 may extend around a corresponding portion of the lid.

In the example shown, projection 70 and recess 28 engage each other or mate to secure lid 14 and the receptacle 12 together. In some examples, lid 14 and receptacle 12 may be secured together using alternate types of mating members. For example, a first mating member such as a recess may be provided on lid 14, and a second mating member such as a projection receivable in the recess may be provided on the receptacle 12.

Lid 14 further comprises a flange 74 positioned above the projection 70. In the example shown, the flange 74 is positioned indirectly above the projection 70. That is, a plurality of intermediate surfaces, 76*a*, 76*b*, and 76*c* are positioned between projection 70 and flange 74, which mate with surfaces 34*a*, 34*b*, and 34*c*, respectively. In some examples, flange 74 may be positioned directly above projection 70 and may extend directly from surface 72.

In the example shown, flange 74 is positioned outwardly of projection 70. However, in alternate examples, flange 74 and projection 70 may at least partially overlap.

Flange 74 is generally configured to seat on the seating surface 36 when the projection 70 is received in the recess 28, or when the lid 14 is otherwise secured to the receptacle 12.

In the example shown, the flange 74 comprises a generally flat outwardly extending surface which extends about the entire periphery of the lid 14. In some examples, flange 74 may be otherwise configured. For example, flange 74 may extend about only a portion of the periphery of the lid 12, or a plurality of flange portions may be provided. Furthermore, in the example shown, flange 74 is positioned outwardly of projection 70. In some examples, flange 74 and projection 70 may at least partially overlap.

Referring to FIGS. 1, 3 and 4, flange 74 has an outer edge 76, which has a concealed portion 78 and a grasping portion 80. When the flange 74 is seated on the seating surface 36, the concealed portion 78 of the outer edge 76 is in perimetrical registration with the barrier wall 38. That is, the perimeter of the concealed portion 78 is in registration with the barrier wall 38. For example, at least a portion of the concealed portion 78 may abut the barrier wall 28. Accordingly, the concealed portion 78 will be generally inaccessible to a user. That is, a user will generally be prevented or inhibited from manually gripping the concealed portion 78 to remove the lid 14 from the receptacle 12.

When the flange 74 is seated on the seating surface 36, the grasping portion 80 is at the gap region 52, and is in perimetrical registration with the member wall 56. That is, the perimeter of the grasping portion is in registration with the member wall. For example, at least a portion of the grasping portion 80 may abut the member wall 56. Accordingly, when the locking member 54 is in the blocking position, the grasping portion 80 is generally inaccessible to a user. That is, a user will generally be prevented or discouraged from manually gripping the grasping portion 80 to remove the lid 14 from the receptacle 12. However, when the locking member 54 is in the non-blocking position, as shown in FIG. 4, the grasping portion 80 will be generally accessible to a user. That is, a user may generally grasp the grasping portion 80 to remove the lid 14 from the receptacle 12.

Various mechanisms of action of the locking member will presently be described.

In the example shown, the locking member 54 is movable from the blocking position to the non-blocking position generally only when it is activated by a user. That is, when the container is shipped, stored, and sold, the locking member is in the blocking position and un-activated. Accordingly, the locking member is generally immovable, and the grasping region, as well as the concealed region, are generally inaccessible to a user. However, after the container is sold, the user may activate the locking member such that it is movable from the blocking position to the non-blocking position. Accordingly, the user may move the locking member to the non-blocking position, such that the grasping region is generally accessible, and the lid may be removed from the receptacle.

For example, in the example shown in FIG. 3, the locking member is un-activated 54. That is, the tab portion 58 of the seating surface 36 is continuous with the barrier wall 38, and accordingly, the locking member 54 is generally immovable, as the tab portion 58 generally holds the locking member 54 in the blocking position.

In order to activate the locking member 54 such that it may be moved from the blocking position to the non-blocking position, the user may sever the seating surface at a first severable portion 82*a* adjacent a first side of the locking member 54, and a second severable portion 82*b* adjacent a second side of the locking member. In the example shown, the first 82*a* and second 82*b* severable portions extend from an outer edge of the tab portion 58 to the hinge line 64. When the severable portions are 82 are severed, the tab portion 58 no longer holds the locking member 54 in the blocking position, and the locking member 54 is activated and may be moved to the non-blocking position. In the example shown, the tab portion 58 of the seating surface 36 comprises visual indicators 84*a*, 84*b*, indicating to a user where to sever the seating surface. However, in alternate examples, visual indicators may not be provided.

The severable portions 82*a*, 82*b* may be configured to be severed in a variety of ways. In the example shown, the severable portions 82 are unbroken and continuous, relative to adjacent material of the receptacle (or base) 12. The severable portions are configured to be severed by using a cutting tool such as a knife or scissors to sever the severable portions, for example, along the visual indicator line 84*a*.

In some examples, the container can comprise slots 86*a*, 86*b*, and the severable portions 82*a*, 82*b* may be aligned with and extend into the first and second slots 86*a*, 86*b*, respectively. Further, the first and second slots may be sized to receive a cutting tool, and to prevent manual access to the outer edge when the locking member is in the upright position. For example, the first and second slots may be less than about 5 mm in width, such that a cutting tool such as a knife blade or scissor blades are insertable therein, and such that, in general, a user may not insert their fingers therein. Accordingly, in such examples, the severable portions may be severed by inserting a cutting tool into the slots, and severing the severable portions.

In some examples, the severable portions 82*a*, 82*b* may not be unbroken and continuous, and may comprise, for example, a perforated line extending thereacross. In order to sever the severable portions 82*a*, 82*b*, the user may manually break the severable portions 82*a*, 82*b* at the perforated line.

When the user has activated the locking member, for example by severing the severable portions, the user may move the locking member 54 from the blocking position to the non-blocking position. When the locking member 54 is in the non-blocking position, the grasping portion 80 becomes generally accessible to the user. Accordingly, the user may grasp the grasping portion 80, and apply force to remove the projection 70 out of the recess 28 and lift the lid 14 off of the receptacle 12. If the user wishes to replace the lid 14 on the receptacle 12, the user may place the lid 14 back on the receptacle 12, and apply force to cause the projection 70 to press back into the recess 28.

Furthermore, prior to purchasing, selling or otherwise using the container 10, the user may inspect the container 10 to see if the locking member 54 has been previously activated. For example, the user may inspect the severable portions 82*a*, 82*b*, to see if they have been severed. If they have been severed, this provides visual evidence to the user that the contents of the container 10 have been accessed since the container 10 was initially sealed, for example, at a factory, and as such, the user may choose not to use the container 10. Accordingly, the container 10 may be generally tamper-proof or tamper-resistant.

In some examples (not shown), the locking member 54 may not be user activated, and may be movable from the blocking position to the non-blocking position without requiring, for example, a step of severing a severable portion 82. For example, the locking member 54 may comprise flexible wing members extending outwardly from the member wall 56 towards the barrier wall 38. When the locking member 54 is in the blocking position, the wing members may extend inwardly of the barrier wall 38 and contact the inner surface of the barrier wall 38, to prevent the locking member 54 from moving to the non-blocking position under the force of gravity, or minor incidental forces. In order to move the locking member 54 to the non-blocking position, a user may grip the locking member 54, and apply a downward force. If the force is sufficient, the flexible wing members will flex and slide out through the gap region 52 to allow the locking member 54 to move to the non-blocking position. When the locking member 54 is in the non-blocking position, the user may grasp the grasping region 80 of the flange, and lift the lid 14 off of the receptacle 12. If the user wishes to replace the lid 14 on the receptacle 12, the user may place the lid 14 on the receptacle 12, and apply force to cause the projection 70 to press into the recess 28. Further, if the user wishes to re-lock the lid 14 onto the receptacle 14, the user may move the locking member 54 to the blocking position, and apply sufficient force such that the wing members flex and slide in through the gap region 52 to re-abut with the barrier wall 38. Such an example may be useful, for example, in order to render the container child-proof.

In the example shown in FIGS. 1 to 4, the locking member 54 is user activated, and once activated, the locking member 54 cannot be relocked. That is, once the severable portions 82 are severed and the locking member is moved to the non-blocking position, the locking member may be manually moved back to the blocking position; however, as the severable portions 82 are severed, the locking member 54 will not generally stay in the blocking position. In some examples, the container 10 may be configured such that after the locking member 54 is activated, the container 10 may be relocked. For example, the wing members described hereinabove may be combined with example shown in FIGS. 1 to 4. Such an example may be both tamper-proof or tamper-resistant, as well as child-proof.

Referring to FIG. 2, in the example shown, lid 14 further comprises a rib 88 positioned inwardly of projection 70, and extending upwardly from projection 70. The rib is generally annular, and extends about the central portion 66 of the lid 14. The rib 88 has an upper end 90 that is positioned above the flange 74, and is configured such that when the lid 14 is secured to the receptacle 12, the upper end 90 of the rib 88 is positioned below the upper end of the barrier wall 38. Further, the rib is configured such that when the lid 14 is secured to the receptacle 12, the distance D between the rib and the barrier wall is generally not large enough to allow a user to insert their fingers therein to grip the rib 88. For example, distance D may be less than about 1 cm. Accordingly, when the lid 14 is secured to the receptacle 12, and the locking member 54 is in the blocking position, the rib 88 may generally not be gripped by a user to remove the lid 14 from the receptacle 12. However, when locking member 54 is in the non-blocking position, a user may grip the rib to remove the lid 14 from the receptacle 12. This may be useful for users who have trouble grasping flange 74 due to the size of flange 74. For example, users with joint problems or vision problems may find it easier to grip rib 88 rather than flange 74. Furthermore rib 88 may be insertable into an indent extending adjacent the periphery of the bottom panel 16 of another container 10, such that the containers may be securely stacked.

The top wall 62 of the locking member 54 can comprise visual indicators instructing a user of how to use the locking member 54. These visual indicators can include text or graphics indicating that the severable portions should be cut or severed, and/or that the locking member should be moved to the unblocked position.

Figure 5:
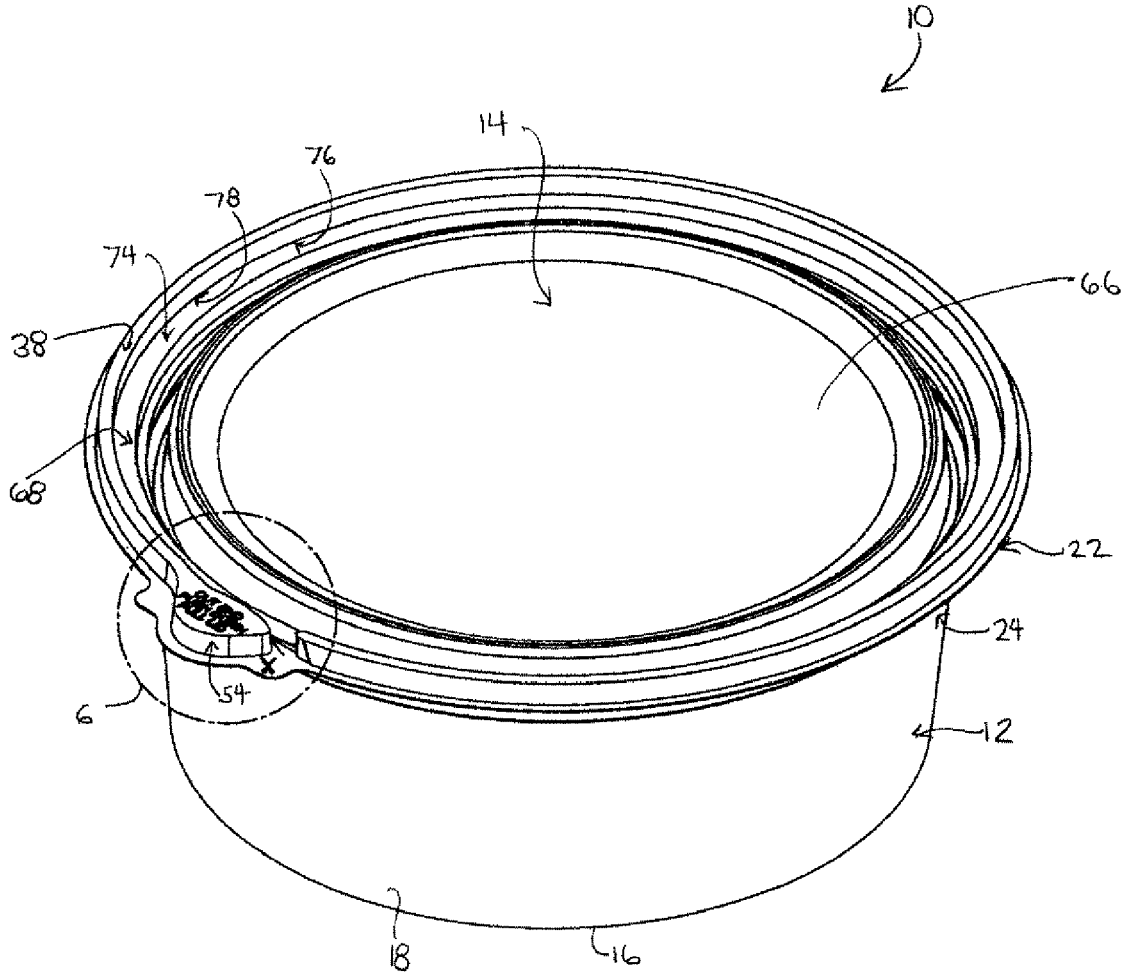
FIG. 5 is a perspective illustration of another example of a container in accordance with the Applicant's teaching.
Figure 6:
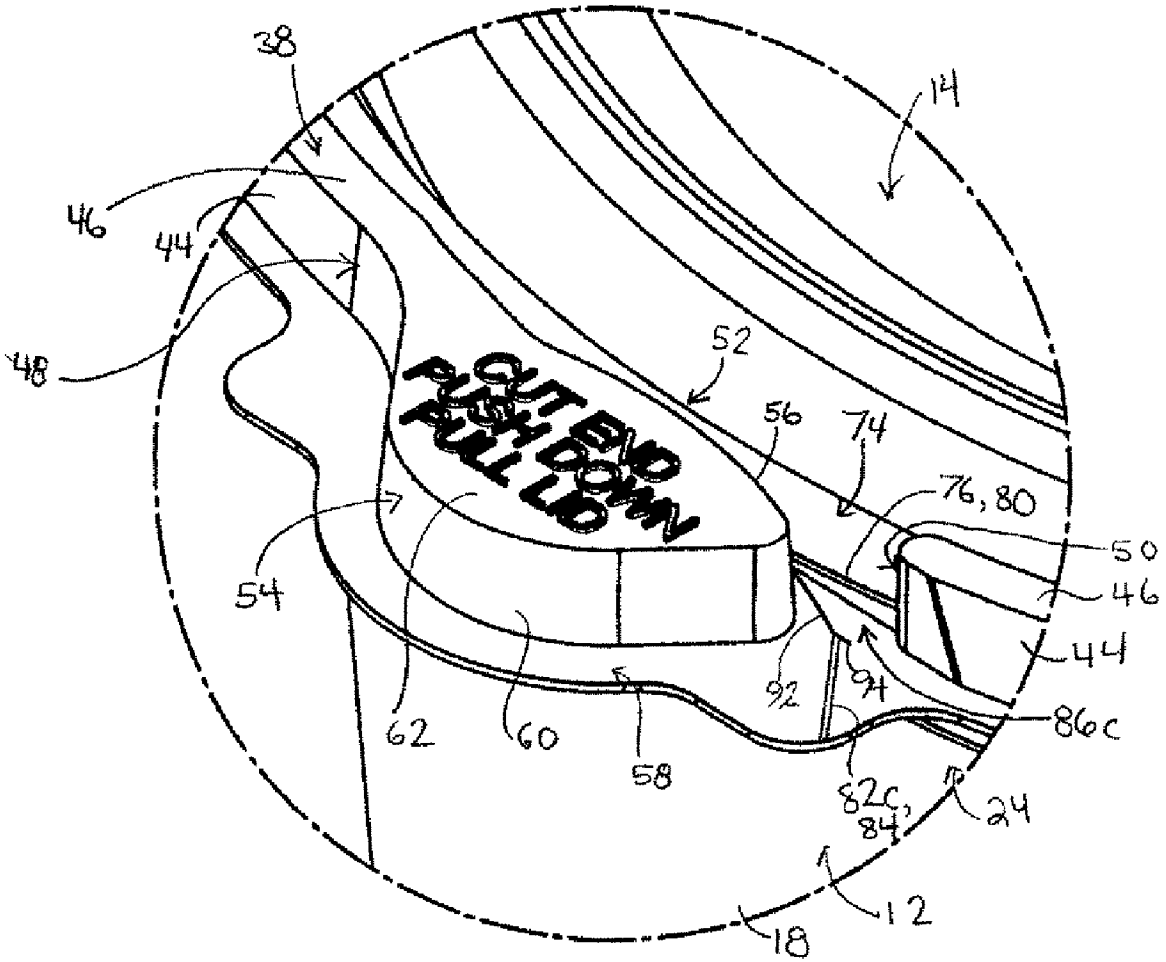
FIG. 6 is an enlarged view of the region shown in circle 6 in FIG. 5.
Figure 7:
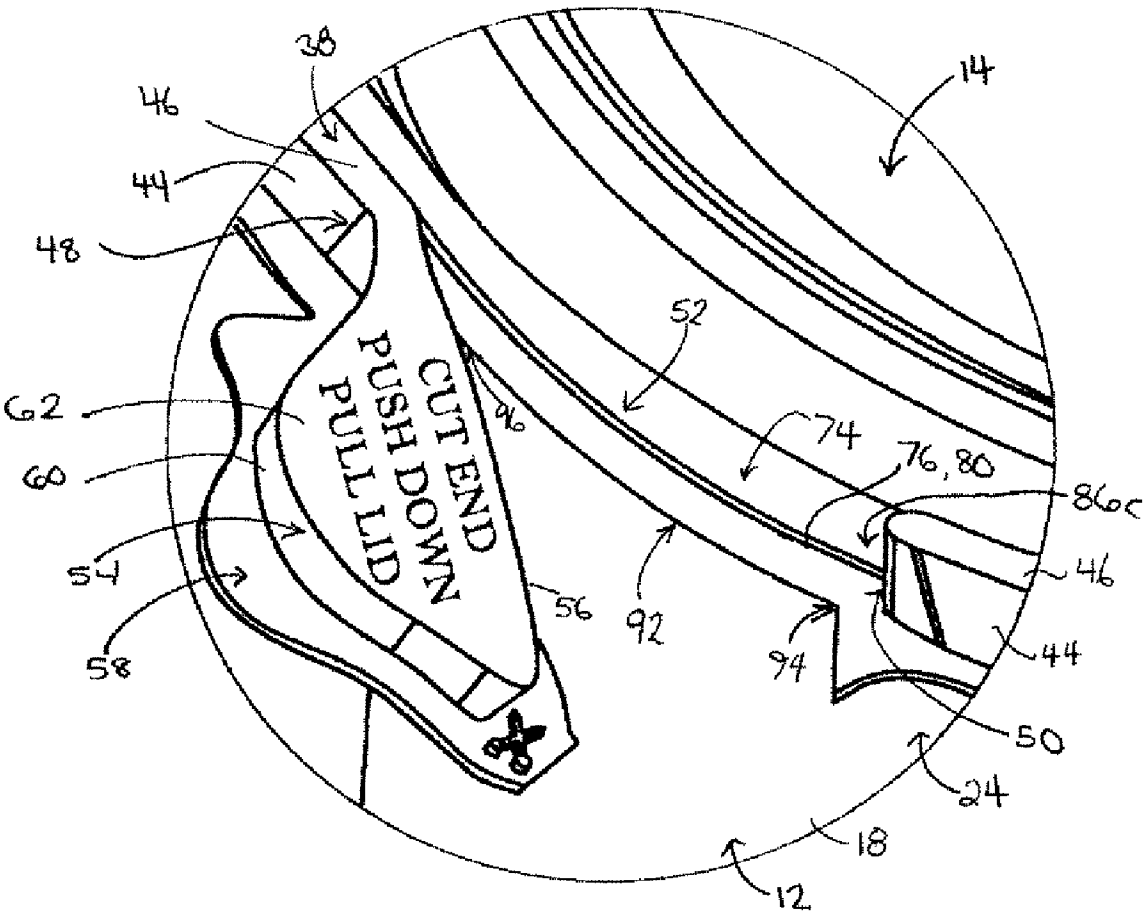
FIG. 7 is an enlarged view of the region shown in circle 6 in FIG. 5, showing the locking member in the non-blocking position.

Another example of a container 10 in accordance with the Applicant's teaching is shown in FIG. 5-7. In this example, the container 10 is similar to the container shown in FIGS. 1-4, however the locking member 54 is continuous with the barrier wall 38 at the first position 48. That is, a severable portion is not provided between a first side of the locking member 54 and the first position 48 of barrier wall 38. However a severable portion 82*c* is provided between a second side of the locking member 54 and the second position 50 of the barrier wall 38.

In addition, a fissure 92 is provided in the tab portion 58, inwardly of the locking member 54. In the example shown, the fissure 92 is a line that is absent material. However, in alternate embodiments, the fissure 92 may be any line that can be easily manually severed by applying force, such as a line of minimal material, or a perforated line. The fissure 92 extends from a first end 94, which is at the severable portion 82*c*, to a second end 96, which is adjacent or proximate the first position 48.

Similarly to the example shown in FIGS. 1-4, when the locking member is in the un-activated position, as shown in FIGS. 5 and 6, the tab portion 58 of the seating surface 36 is continuous with the barrier wall 38, and accordingly, the locking member 54 is generally immovable, as the tab portion 58 generally holds the locking member 54 in the blocking position. In use, in order to activate the locking member, the user may sever the tab portion 58 at the severable portion 82*c*, such that the severed portion is continuous with the fissure 92. For example, the user may insert a cutting tool, such as a knife or a pair of scissors, into a slot 86*c* defined between the locking member 54 and the second position.

When the severable portion 82*c* is severed, the locking member is activated and may be moved to the non-blocking position, as shown in FIG. 7. That is, as the severed portion is continuous with the fissure 92, the tab portion 58 no longer holds the locking member in the blocking position. In order to move the locking member to the non-blocking position, the user may apply downward force to the locking member. When force is applied, the portion of the receptacle at or adjacent the second end 96 of the fissure 92 will bend or flex. That is the portion of the locking member, barrier wall, and/or tab portion at or adjacent the first position will bend or flex, and the locking member will move to the non-blocking position.

Alternately or in addition, in the example shown in FIGS. 5-7, when the severed portion is severed, the locking member may automatically recoil or flex to or towards the non-blocking position. This may occur due to a release of tension that occurs when the severable portion is severed.

Accordingly, the grasping portion 80 will become generally accessible to the user, and the user may grasp the grasping portion 80, and apply force to remove the projection 70 out of the recess 28 and lift the lid 14 off of the receptacle 12.

It will be appreciated that certain features, which are, for clarity, described in the context of separate examples or separate aspects, may also be provided in combination in a single example. Conversely, various features, which are, for brevity, described in the context of a single example or aspect, may also be provided separately or in any suitable sub-combination.

Although the invention has been described in conjunction with specific examples thereof, it is evident that many alternatives, modifications and variations will be apparent to those skilled in the art. Accordingly, it is intended to embrace all such alternatives, modifications and variations that fall within the spirit and broad scope of the appended claims. In addition, citation or identification of any reference in this application shall not be construed as an admission that such reference is available as prior art to the present invention.

The invention claimed is:

1. A container comprising:

a) a receptacle having a bottom panel, at least one side wall extending upwardly from the bottom panel, and a lid coupling region extending from an upper portion of the at least one side wall, the lid coupling region comprising:

(i) at least one engagement surface extending from the upper portion of the at least one side wall to define an inwardly open recess;

(ii) a seating surface positioned above the recess;

(iii) a barrier wall extending upwardly from an outer portion of the seating surface and extending about a portion of the periphery of the receptacle, from a first position to a second position spaced perimetrically apart from the first position, defining a gap region between the first and second positions; and (iv) a locking member positioned at the gap region and comprising a member wall extending upwardly from the outer portion of the seating surface, the locking member being movable from a blocking position to a non-blocking position; and b) a lid having a receptacle coupling region extending about the periphery thereof, the receptacle coupling region comprising;

(i) a projection receivable in the recess; and (ii) a flange positioned above and outwardly of the projection and having an outer edge, the flange being seatable on the seating surface when the projection is received in the recess, (iii) the outer edge comprising a concealed portion in perimetrical registration with the barrier wall, and a grasping portion in perimetrical registration with the member wall, the grasping portion being generally inaccessible to a user when the locking member is the blocking position, and being generally accessible to a user when the locking member is in the non-blocking position, wherein the seating surface comprises a first severable portion defined adjacent a first side of the locking member, and a second severable portion defined adjacent a second side of the locking member, and wherein the locking member is user activated such that when the severable portions are severed by a user, the locking member is movable from the blocking position to the non-blocking position.

2. The container of claim 1, wherein the severable portions are unbroken and continuous.

3. The container of claim 1, wherein the seating surface comprises a tab portion extending outwardly of the member wall, the tab portion continuous with the barrier wall, and the severable portions disposed in the tab portion.

4. The container of claim 3, wherein the tab portion comprises visual indicators identifying the severable portions.

5. The container of claim 4, further comprising a first slot defined between the locking member and the first position, and a second slot defined between the locking member and the second position.

6. The container of claim 5, wherein the first and second slots are aligned with the first and second severable portions, respectively, and are sized to receive a cutting tool.

7. The container of claim 6, wherein the first and second slots are sized to prevent manual access to the outer edge when the locking member is in the blocking position.

8. The container of claim 1, wherein the member wall is generally in perimetrical alignment with the barrier wall.

9. The container of claim 1, wherein the locking member is pivotable about a hinge line defined in the seating surface.

10. The container of claim 9, wherein the hinge line comprises a creased region of the seating surface.

11. The container of claim 9, wherein the wherein the locking member is positioned outwardly of the barrier wall, and the hinge line is positioned in the gap region between the locking member and the barrier wall.

12. The container of claim 1, wherein the outer portion is visible when the container is viewed from above along an axis extending transversely to the seating surface.

13. The container of claim 1, wherein the barrier wall and the outer portion meet at an angle of 90 degrees or greater.

14. The container of claim 1, wherein the barrier wall comprises an inner wall portion, an outer wall portion, and a top wall portion extending therebetween.

15. A container comprising:

a) a receptacle having a bottom panel, at least one side wall extending upwardly from the bottom panel, and a lid coupling region extending from an upper portion of the at least one side wall, the lid coupling region comprising:

(i) at least one engagement surface extending from the upper portion of the at least one side wall to define an inwardly open recess;

(ii) a seating surface positioned above the recess;

(iii) a barrier wall extending upwardly from an outer portion of the seating surface and extending about a portion of the periphery of the receptacle, from a first position to a second position spaced perimetrically apart from the first position, defining a gap region between the first and second positions; and (iv) a locking member positioned at the gap region and comprising a member wall extending upwardly from the outer portion of the seating surface, the locking member being movable from a blocking position to a non-blocking position; and b) a lid having a receptacle coupling region extending about the periphery thereof, the receptacle coupling region comprising;

(i) a projection receivable in the recess; and (ii) a flange positioned above and outwardly of the projection and having an outer edge, the flange being seatable on the seating surface when the projection is received in the recess, (iii) the outer edge comprising a concealed portion in perimetrical registration with the barrier wall, and a grasping portion in perimetrical registration with the member wall, the grasping portion being generally inaccessible to a user when the locking member is the blocking position, and being generally accessible to a user when the locking member is in the non-blocking position, wherein a first side of the locking member is continuous with the barrier wall adjacent the first position, and the seating surface comprises a first severable portion defined adjacent a second side of the locking member, and a fissure extending from a first end at the first severable portion to a second end proximate the first position, and wherein the locking member is user activated such that when the severable portions are severed by a user, the locking member is movable from the blocking position to the non-blocking position.

16. The container of claim 15, wherein a portion of the receptacle adjacent the first position bends to move the locking member from the blocking position to the non-blocking position.

17. The container of claim 15, wherein the fissure comprises a line absent any material.

18. The container of claim 15, wherein the seating surface comprises a tab portion extending outwardly of the member wall, the tab portion continuous with the barrier wall, and the severable portion is disposed in the tab portion.

19. The container of claim 15, further comprising a slot defined between the locking member and the second position.

* * * * *